US009324314B2

(12) United States Patent
Park et al.

(10) Patent No.: US 9,324,314 B2
(45) Date of Patent: Apr. 26, 2016

(54) SYSTEM FOR CONTROLLING VEHICLE INTERIOR SOUND USING SMART PHONE AND METHOD THEREOF

(71) Applicant: Hyundai Motor Company, Seoul (KR)

(72) Inventors: Dong Chul Park, Anyang-si (KR); Seoung Hyeon Kim, Anyang-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 149 days.

(21) Appl. No.: 14/287,981

(22) Filed: May 27, 2014

(65) Prior Publication Data

US 2015/0124989 A1 May 7, 2015

(30) Foreign Application Priority Data

Nov. 1, 2013 (KR) ..... 10-2013-0132031

(51) Int. Cl.
*G10K 11/16* (2006.01)
*G10K 11/178* (2006.01)

(52) U.S. Cl.
CPC ..... *G10K 11/178* (2013.01); *G10K 2210/1282* (2013.01); *G10K 2210/12821* (2013.01); *G10K 2210/12822* (2013.01); *G10K 2210/3011* (2013.01); *G10K 2210/3225* (2013.01)

(58) Field of Classification Search
None
See application file for complete search history.

(56) References Cited

U.S. PATENT DOCUMENTS

2003/0200014 A1* 10/2003 Remboski ..... G01M 13/028 701/33.9
2009/0225995 A1* 9/2009 Kotegawa ..... H03G 3/32 381/57
2012/0053805 A1* 3/2012 Dantu ..... B60W 40/09 701/70
2012/0101819 A1* 4/2012 Heiman ..... H04R 1/1083 381/74
2012/0130580 A1* 5/2012 Omote ..... G10K 15/02 701/22
2014/0085071 A1* 3/2014 Tsuzuki ..... G10K 15/02 340/466

FOREIGN PATENT DOCUMENTS

JP 2899205 B2 6/1999
JP 2012-131244 A 7/2012
KR 2001-0005260 A 1/2001
KR 10-2010-0138431 A 12/2010
KR 10-2012-0060513 A 6/2012
KR 10-2012-0062527 A 6/2012
KR 10-2012-0075555 A 7/2012

* cited by examiner

*Primary Examiner* — Thang Tran
(74) *Attorney, Agent, or Firm* — McDermott Will & Emery LLP

(57) ABSTRACT

A system for controlling vehicle interior sound using a smart phone and a method thereof include a driving information provider to provide driving information while a vehicle is being driven. A smart phone includes a microphone which senses interior noise or sound of the vehicle and generates a sound control signal to diminish or amplify the interior noise based on the driving information from the driving information provider. An audio amplifier amplifies the sound control signal received from the smart phone and outputs an amplified signal though a speaker.

11 Claims, 7 Drawing Sheets

– One example of transfer function measurement –

(a) When control signal has antiphase, synthesized noise is diminished as level '0'

(b) Control signal having arbitrary phase (c) Case of control signal having inphase - Noise is amplified two times

SYSTEM FOR CONTROLLING VEHICLE INTERIOR SOUND USING SMART PHONE AND METHOD THEREOF

CROSS-REFERENCE TO RELATED APPLICATION

This application claims under 35 U.S.C. §119(a) the benefit of priority to Korean Patent Application No. 10-2013-0132031 filed Nov. 1, 2013, the entire contents of which are incorporated herein by reference.

TECHNICAL FIELD

The present disclosure relates to a system for controlling vehicle interior sound using a smart phone and a method thereof. More particularly, the present disclosure relates to a system for controlling vehicle interior sound using a smart phone which is capable of reducing or increasing the vehicle interior sound and serves as a controller for controlling noise, and a method thereof.

BACKGROUND

A technique of controlling vehicle interior sound, that is a technique of controlling active noise, is applied to an audio system or an additional controller in a vehicle to reduce interior noise or reproduce arbitrary sound.

Further, there is a technique of implementing a sound set according to user preferences in a smart phone application. For example, a system for synthesizing and reproducing vehicle sound disclosed in Korean Patent Application Publication No. 2013-0054031 (published on May 24, 2013) synthesizes sound reproduced and downloaded through a smart phone according to user preferences and interior noise made by mixing engine driving noise and intake/exhaust noise.

However, the technique of implementing an arbitrary sound using a smart phone synthesizes engine noise and the sound reproduced and downloaded through the smart phone which corresponds to the engine noise or is the stored engine noise in connection with vehicle information such as revolution per minute (RPM). In addition, since such a technique simply adds an additional sound to the engine noise, it is impossible to reduce or amplify the interior noise.

In other words, the engine noise introduced into a vehicle is combined with the sound downloaded from a web server through the smart phone according to user preferences to reproduce the combined sound through an audio amplifier. Since this technique simply adds the user preference sound to the engine noise, a driver and passengers may rather feel unpleasant from the combined sound of the vehicle sound such as engine noise and the user preference sound. Specifically, it is impossible to reduce or cancel the noise generated from the vehicle.

SUMMARY OF THE DISCLOSURE

The present disclosure has been made in an effort to solve the above-described problems associated with prior art. The present disclosure provides a system of controlling vehicle interior sound using a smart phone which is capable of adjusting vehicle interior noise such as engine sound at a user desired level by diminishing or amplifying the vehicle interior noise according to a situation. The smart phone is used as a controller (audio system or additional controller) instead of the conventional controller in order to control the interior sound differently from synthesizing and superimposing sound on sound.

In addition, the present disclosure provides a system of controlling a vehicle interior sound using a smart phone which is capable of transmitting an arbitrary engine sound designed by a user to a web server through a smart phone to share it in public when interior sound is controlled, and a method thereof.

In order to achieve the above object, there is provided a system for controlling vehicle interior sound using a smart phone according to an exemplary embodiment of the present disclosure. The system includes a driving information provider configured to provide driving information while a vehicle is being driven. A smart phone includes a microphone which senses interior noise or sound of the vehicle, and generates a sound control signal to diminish or amplify the interior noise based on the driving information from the driving information provider. An audio amplifier amplifies the sound control signal received from the smart phone and to output an amplified signal though a speaker.

The driving information provider includes an on board diagnostics (OBD) terminal of the vehicle which communicates with the smart phone through Wi-Fi or Bluetooth.

The system further includes a supplementary microphone installed inside the vehicle.

The smart phone includes a real-time adaptive filter to generate a signal having a phase opposite to that of current sound sensed through the microphone.

The system further includes a sound source sharing server which interior noise designed at a user desired level is uploaded to or downloaded from through the smart phone.

The driving information includes a vehicle speed and an engine revolution per minute (RPM).

According to another exemplary embodiment of the present disclosure, there is provided a method of controlling vehicle interior sound using a smart phone. The method provides driving information to the smart phone while a vehicle is being driven. Interior noise or acoustic information of the vehicle is sensed through a microphone of the smart phone. A sound control signal is generated from the smart phone based on the driving information to diminish or amplify the interior noise. The sound control signal received from the smart phone is amplified to output an amplified signal through a speaker. The interior noise is controlled by diminishing or amplifying the interior noise through the sound output from the speaker.

The method further includes automatically calculating an interior transfer function of the sound output from the speaker and measured by the microphone of the smart phone when the sound control signal of the smart phone is amplified and output through the speaker.

The controlling of the interior noise includes comparing an interior noise level sensed by the microphone of the smart phone with a sound profile desired by a user. A sound control signal is generated, which has the same frequency as that of the interior noise and a phase opposite to that of the interior noise when the interior noise level is greater than the profile such that the sound control signal diminishes the interior noise. The sound control signal is generated, having the same frequency and phase as those of the interior noise when the interior noise level is lower than the profile such that the interior noise is amplified.

The method further includes designing the profile of sound desired by a user, and sharing the designed profile through the sound source sharing server to and from which the smart phone downloads and uploads the designed profile.

Accordingly, the system for controlling vehicle interior sound using a smart phone and the method thereof according to the present disclosure have the following advantages.

According to the present disclosure, the controller and the acoustic sensor for the active noise control according to the related art are replaced with the smart phone so that the system structure for the active noise control can be simplified. Specifically, regardless whether the active noise control system is installed in a vehicle or not, the active noise control system can be constructed in the vehicle together with a private smart phone.

Further, the conventional expensive controller and acoustic sensor are replaced with a smart phone, so that, the noise control system can be constructed at low cost.

In addition, the sound generated from a vehicle is measured and analyzed through a microphone of the smart phone, and the control algorithm is provided to diminish and amplify the analyzed sound. Therefore, a user desired sound profile can be implemented as compared with the system for simply synthesizing and reproducing sound according to the related art.

BRIEF DESCRIPTION OF THE DRAWINGS

The above and other features of the present disclosure will now be described in detail with reference to certain exemplary embodiments thereof illustrated by the accompanying drawings which are given hereinbelow by way of illustration only, and thus are not limitative of the present disclosure.

Figure 1:
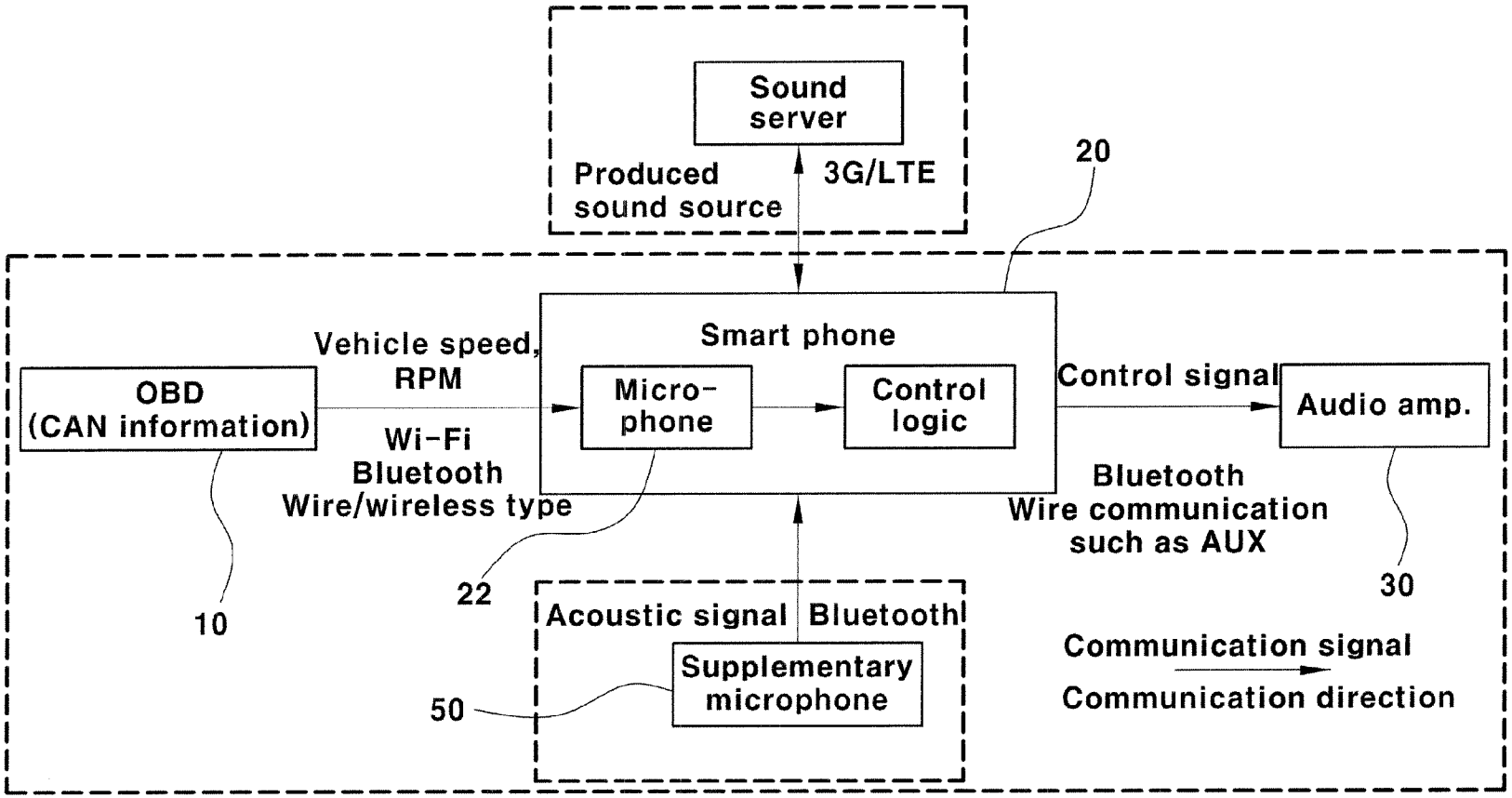
FIG. 1 is a block diagram showing a system for controlling vehicle interior sound using a smart phone according to an embodiment of the present disclosure.

It should be understood that the appended drawings are not necessarily to scale, presenting a somewhat simplified representation of various features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Hereinafter, the present disclosure will be described in detail with reference to the accompanying drawings.

In general, the present disclosure provides a technique of controlling vehicle interior sound in which specific sound is synthesized by reducing a booming noise or generating arbitrarily engine sound. In order to implement a basic function for generating engine sound and an active noise control (ANC) for reducing sound, a combination of a controller and an interior microphone is required.

According to the present disclosure, the conventional controller and indoor microphone are replaced with a smart phone, and a microphone installed in the smart phone is used for an error signal of interior noise. In addition, instead of the conventional controller of an audio unit, a control algorithm is applied in a smart phone application, so that the smart phone having a microphone serves as a controller.

Referring to FIG. 1, a system for controlling interior sound according to the present disclosure includes a driving information provider 10 for providing information about a speed and an revolution per minute (RPM) of a vehicle to a smart phone 20 while the vehicle is being driven. An on board diagnostics (OBD) terminal, which communicates with the smart phone 20 through Wi-Fi or Bluetooth, may serve as the driving information provider 10.

A microphone 22 is installed in the smart phone 20. The microphone 22 senses interior noise or sound of the vehicle.

Specifically, the smart phone 20 includes a control logic for generating a sound control signal to diminish or amplify the interior noise based on the driving information provided from the driving information provider 10 and the interior noise sensed by the microphone 22.

For example, since a level of the interior noise (for example, engine sound) caused by variations of a vehicle speed and an engine RPM is varied, when the microphone 22 measures a current interior noise, the smart phone 20 generates the sound control signal to diminish or amplify the current interior noise based on the driving information.

To this end, the smart phone 20 includes a real-time adaptive filter for generating a signal having a phase opposite to that of the current sound sensed through the microphone 22. In this case, if the smart phone 20 outputs the sound control signal to an audio amplifier 30, the audio amplifier 30 amplifies the sound control signal to output the sound corresponding to the sound control signal through a speaker.

In addition, the driving information provider 10 may be in communication with the smart phone 20 through a wireless communication scheme such as Wi-Fi or Bluetooth, or a wire communication scheme. The smart phone 20 may be in communication with the audio amplifier 30 through a wireless communication scheme such as Wi-Fi or Bluetooth, or a wire communication scheme.

Thus, when the sound control signal received from the smart phone 20 is amplified and outputted through the speaker, the interior noise (engine sound) is diminished and amplified with the sound output from the speaker, so that the noise is controlled.

Meanwhile, a supplementary microphone 50 may be further installed at a predetermined position, such as a headrest or a head lining of a seat in the vehicle, such that, the interior noise is more precisely measured. The interior noise measured by the supplementary microphone 50 may be transmitted to the smart phone through wire/wireless communication.

The smart phone 20 may communicate with an additional sound source sharing server 40 to upload or download the interior noise designed at a degree of user preference.

Hereinafter a method of controlling vehicle interior sound according to the present disclosure will be described as follows.

While a vehicle is being driven, driving information about a vehicle speed and an engine RPM is transmitted from the driving information provider 10 to the smart phone 20. At the same time, the interior noise (engine sound) or sound of the vehicle is sensed by the microphone 22 of the smart phone 20.

Then, the control logic for generating a sound control signal is executed in the smart phone 20, so that a sound control signal for diminishing or amplifying the interior noise is generated based on the driving information provided from the driving information provider 10 and the interior noise sensed by the microphone 22.

For example, a signal of the interior noise signal sensed by the microphone 22 is allowed to pass through the real-time adaptive filter, so that the sound control signal may be generated to diminish or amplify the interior noise.

The sound control signal generated from the smart phone is transmitted to the audio amplifier, such that, the audio amplifier amplifies the sound control signal received from the smart phone and outputs the amplified signal through the speaker. Thus, the interior noise is diminished and amplified with the sound output through the speaker so that the noise control is completed.

Figure 2:
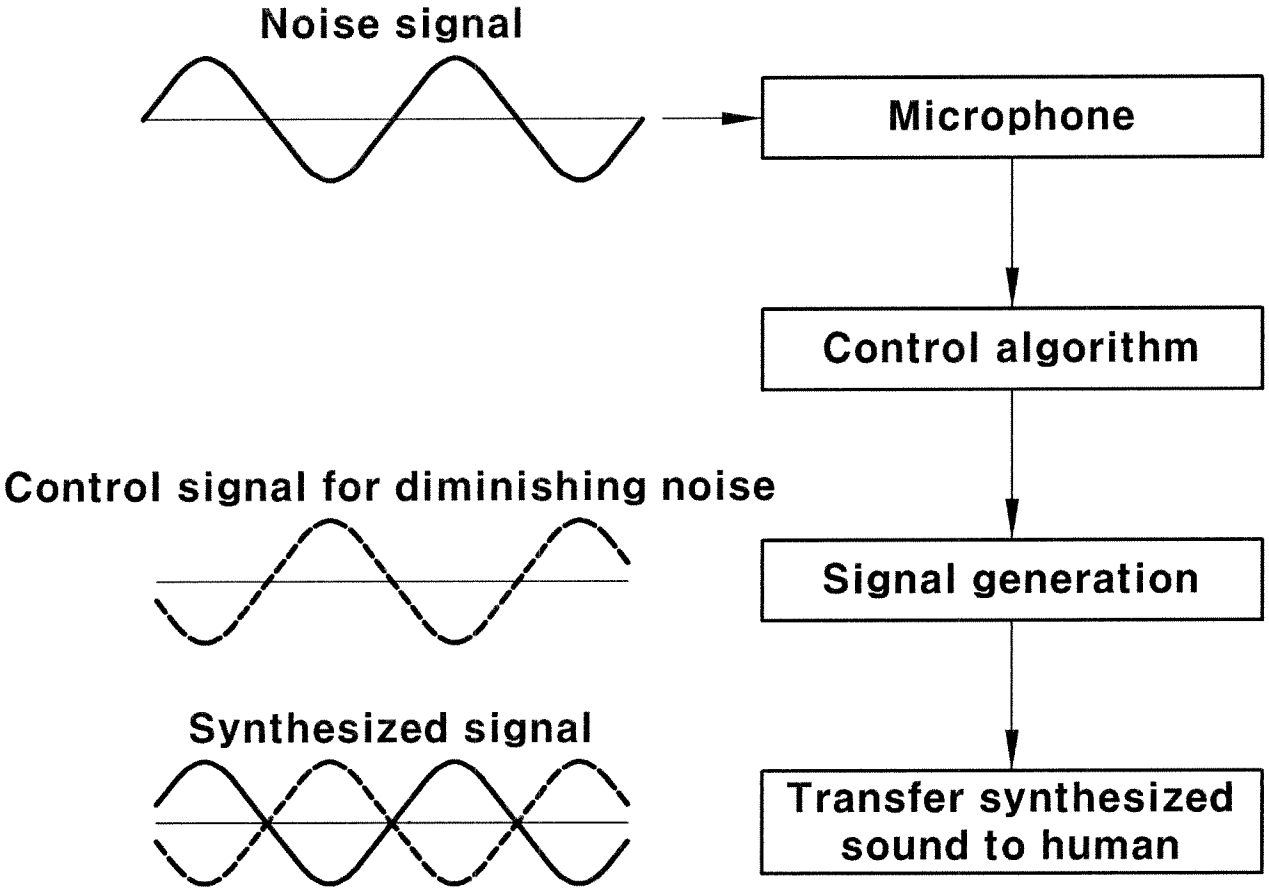
FIG. 2 is a view illustrating a method of controlling vehicle interior sound using a smart phone according to an embodiment of the present disclosure.

In this case, the sound control signal for diminishing the interior noise is used to generate the sound having the same volume as that of the interior noise and the phase opposite to that of the interior noise. To this end, as described above, the volume and noise of the current interior noise are measured through the microphone, and as shown in FIG. 2, the sound control signal having the phase opposite to that of the interior noise is generated through the real-time adaptive filter in order to diminish the interior noise.

Figure 5:
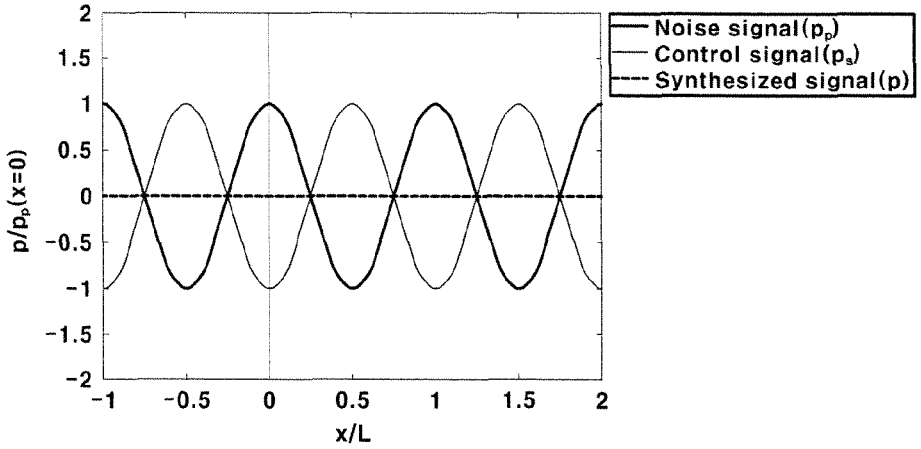
FIGS. 5 and 6 are waveforms illustrating an example of controlling vehicle interior sound using a smart phone according to an embodiment of the present disclosure.
Figure 5:
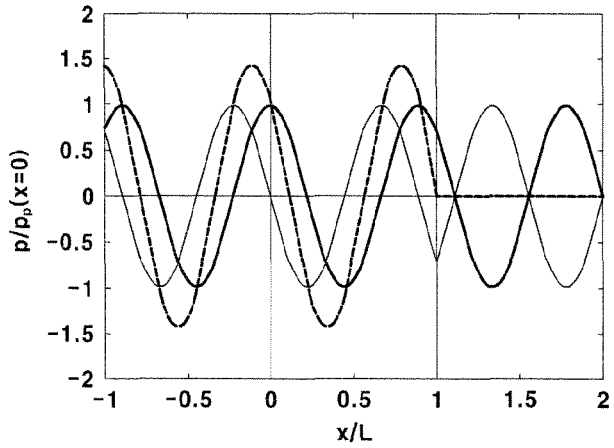
Figure 5:
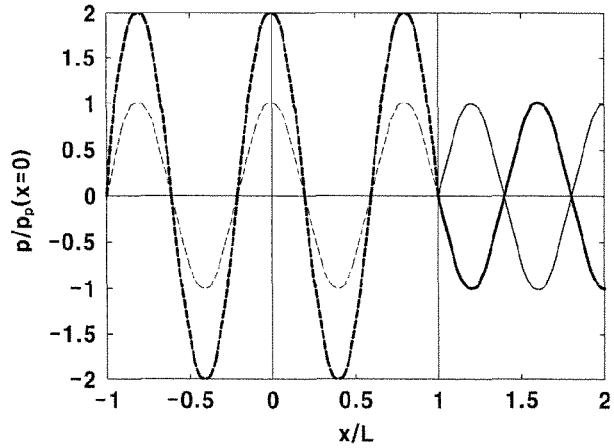

For example, as shown in FIG. 5(*a*), if the sound control signal has the phase opposite to that of the interior noise signal, the sound output from the speaker diminishes the interior noise so that the synthesized sound may become zero. As shown in FIGS. 5(*b*) and 5(*c*), if the sound control signal has an arbitrary phase or the same phase as that of the interior noise signal, the sound output from the speaker is superimposed on the interior noise, so that the synthesized sound may be amplified and doubled.

Figure 6:
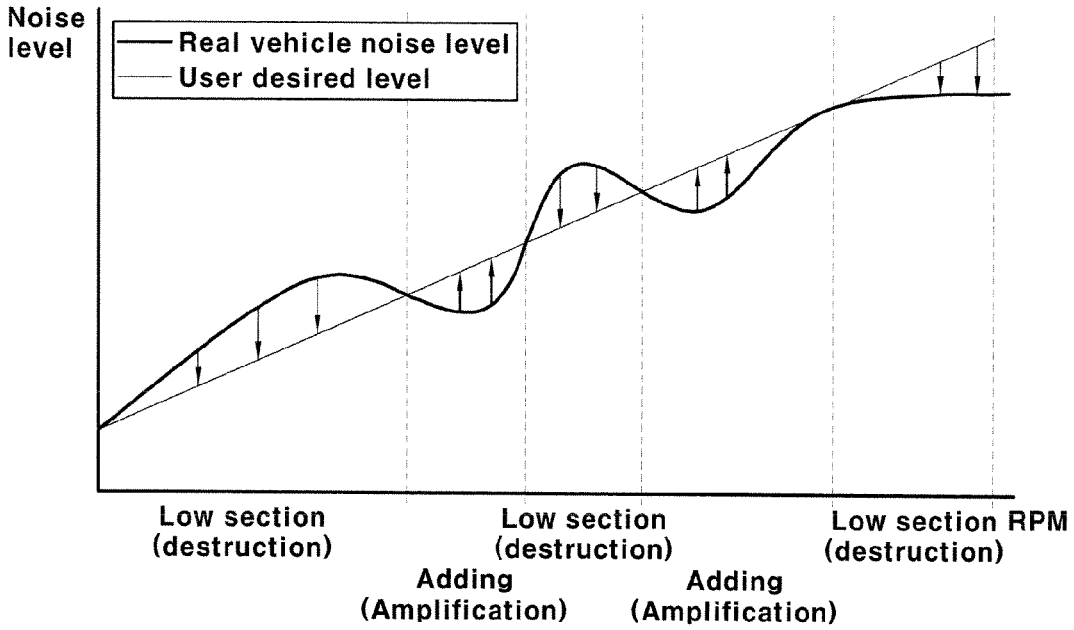

One example of the interior noise control will be described with reference to FIG. 6. The interior noise control includes comparing a level of the interior noise sensed by the microphone of the smart phone with a profile of a sound level desired by a user. A sound control signal is generated, which has the same frequency as that of the interior noise and a phase opposite to that of the interior noise when the interior noise level is greater than the profile such that the sound control signal diminishes the interior noise. The sound control signal is generated, which has the same frequency and phase as those of the interior noise when the interior noise level is lower than the profile such that the interior noise is amplified. Therefore, the user may listen to the sound corresponding to the sound profile desired by the user.

Meanwhile, a transfer function is required between the speaker of the vehicle and the smart phone for the purpose of the active noise control of the interior noise. The transfer function is a relation between the speaker and the microphone (corresponding to human's ears) and the measurement of the transfer function is to measure acoustic space characteristic of a vehicle. Since all vehicles have interior structures and acoustic spaces different from each other, the transfer functions of each vehicle must be measured to perform the active noise control.

Figure 3:
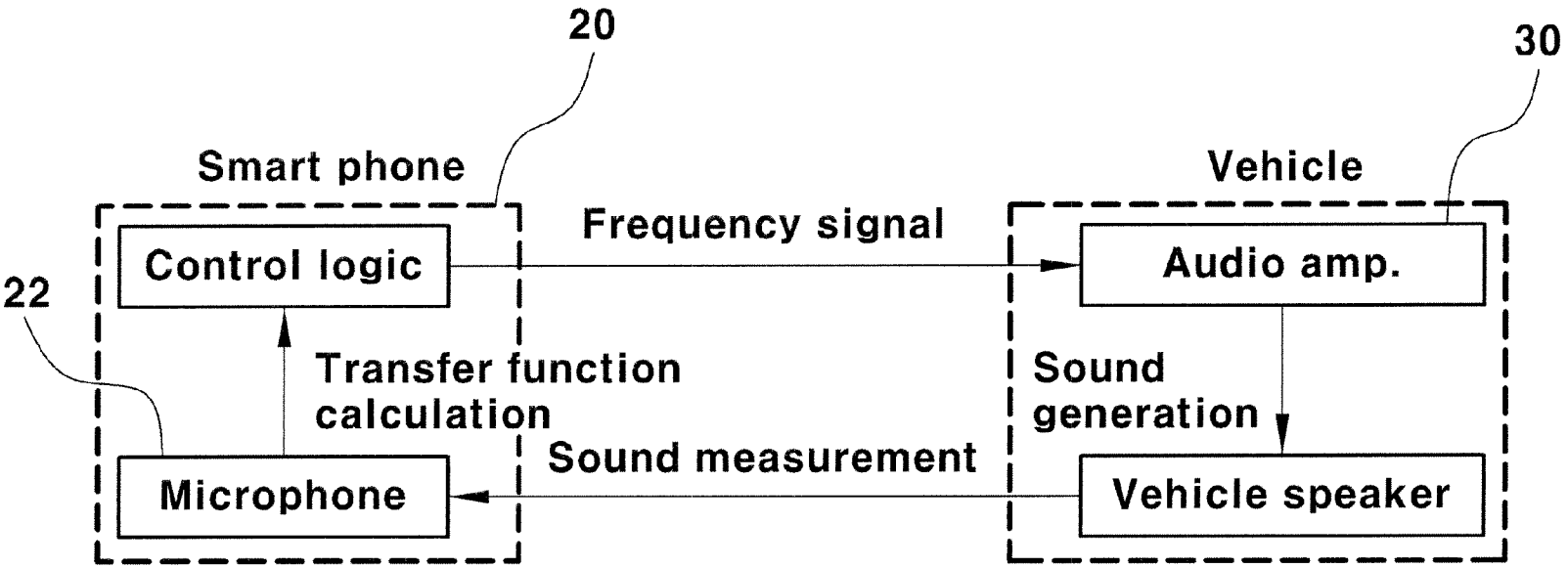
FIG. 3 is a block diagram showing a configuration of measuring a transfer function for controlling vehicle interior sound using a smart phone according to an embodiment of the present disclosure.
Figure 4:
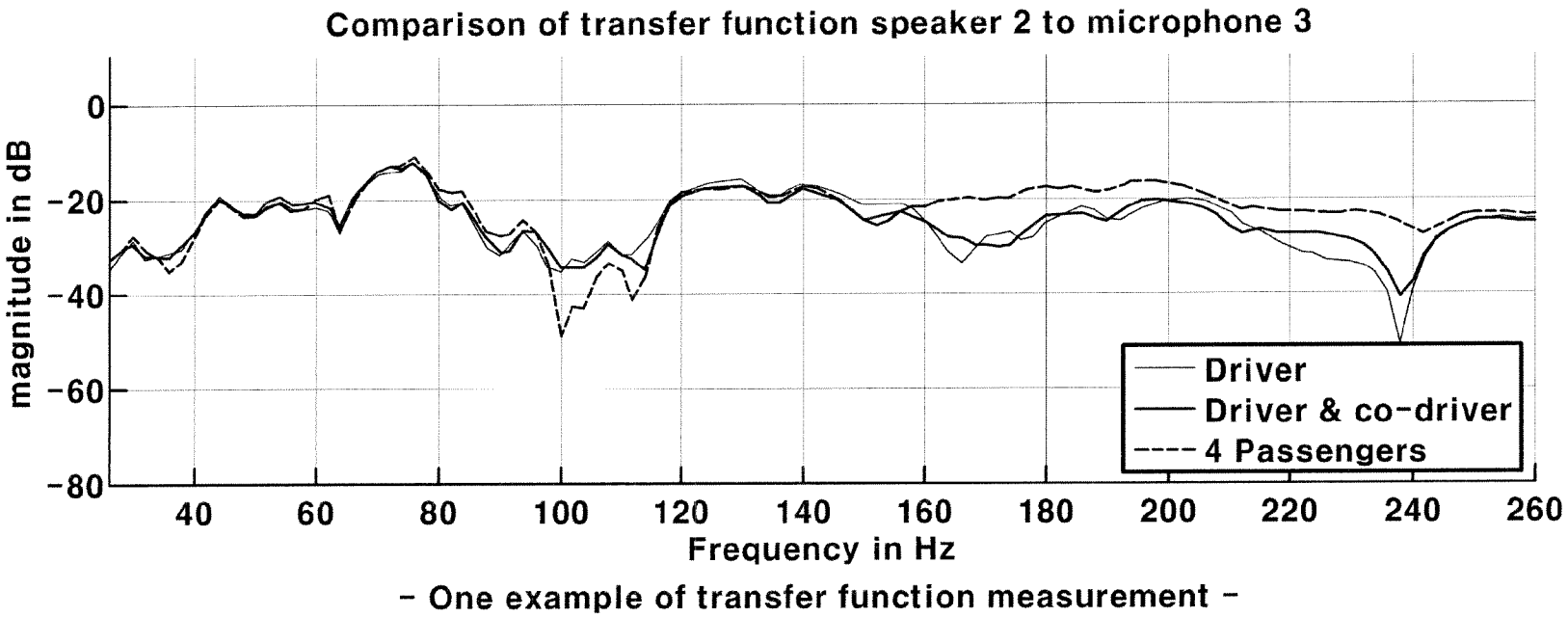
FIG. 4 is a graph showing an example of measuring a transfer function for controlling vehicle interior sound using a smart phone according to an embodiment of the present disclosure.

As shown in FIG. 3, when the sound control signal of the smart phone is amplified and output through the speaker, the output sound is measured by the microphone of the smart phone. Then, the control logic of the smart phone automatically calculates the transfer function based on the measured sound by the microphone, so that the smart phone outputs the sound control signal having a more exact waveform to the audio amplifier based on the calculated transfer function.

That is, phenomena, such as a phase delay due to a circuit, which may be caused in a sound generating end (amplifier) and a sound measuring end (microphone), a delay due to a calculation speed, and sound amplifying/diminishing in a vehicle acoustic space, can be compensated through the automatic measurement of the transfer function.

The method of controlling interior sound according to the present disclosure further includes designing a sound desired profile by a user, and sharing the designed profile through the sound source sharing server to and from which the smart phone downloads and uploads the designed profile.

Figure 7:
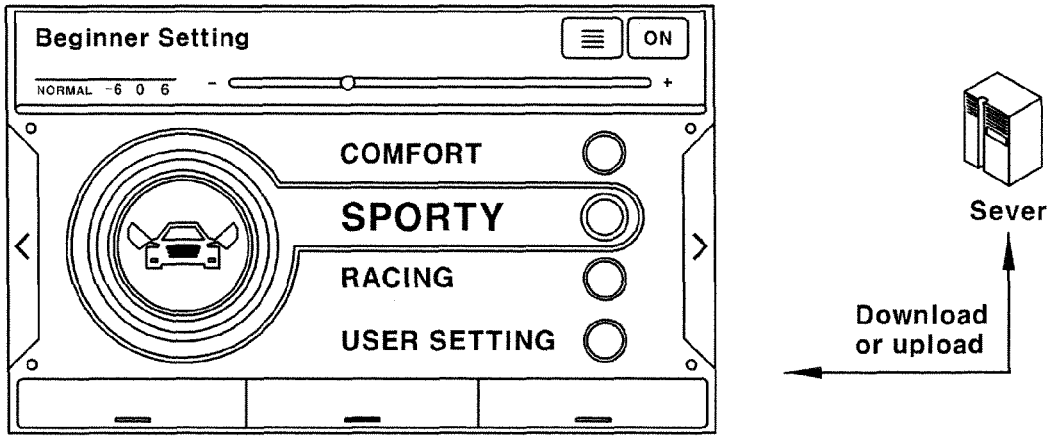
FIG. 7 is a view showing an example of a smart phone application for controlling vehicle interior sound according to an embodiment of the present disclosure.

That is, after a smart phone application is implemented as shown in FIG. 7, a level of the interior noise may be designed into a user desired sound profile by using menus of the smart phone application, such as, comfort, sporty, racing, and user setting.

Figure 8:
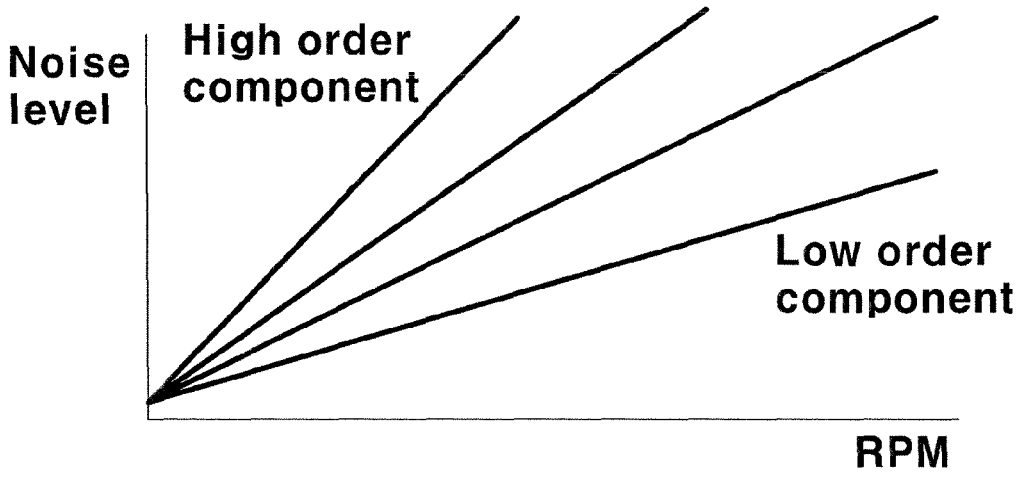
FIG. 8 is a graph illustrating an example of setting a user desired noise profile for controlling vehicle interior sound according to an embodiment of the present disclosure.

Further, as shown in FIG. 8, high and low order components may be added to the user desired sound profile, so that, the user desired sound profile may be variously implemented.

For example, when a driver of a vehicle having four cylinders desires sound of a vehicle having six or eight cylinders or a sports car, the driver may control engine order components to variously design the sound profile having a desired level.

Such a designed sound profile may be uploaded to the sound source sharing server in the type of smart phone application, so that the designed sound profile may be shared in public.

As described above, according to the present disclosure, the controller and the acoustic sensor for the active noise control according to the related art are replaced with the smart phone so that the system structure for the active noise control can be simplified. Specifically, regardless whether the active noise control system is installed in a vehicle or not, the active noise control system can be constructed in a vehicle together with a private smart phone.

What is claimed is:

1. A system for controlling vehicle interior sound using a smart phone, comprising:

a driving information provider configured to provide driving information while a vehicle is being driven;

a smart phone including a microphone which senses interior noise or sound of the vehicle, the smart phone configured to generate a sound control signal to diminish or amplify the interior noise based on the driving information from the driving information provider; and an audio amplifier configured to amplify the sound control signal received from the smart phone and to output an amplified signal though a speaker.

2. The system of claim 1, wherein the driving information provider includes an on board diagnostics (OBD) terminal of the vehicle which communicates with the smart phone through Wi-Fi or Bluetooth.

3. The system of claim 1, further comprising: a supplementary microphone installed inside the vehicle.

4. The system of claim 1, wherein the smart phone includes a real-time adaptive filter to generate a signal having a phase opposite to that of current sound sensed through the microphone.

5. The system of claim 1, further comprising: a sound source sharing server which interior noise designed at a user desired level is uploaded to or downloaded from through the smart phone.

6. The system of claim 1, wherein the driving information includes a vehicle speed and an engine revolution per minute (RPM).

7. A method of controlling vehicle interior sound using a smart phone, the method comprising:

providing driving information to the smart phone while a vehicle is being driven;

sensing interior noise or acoustic information of the vehicle through a microphone of the smart phone;

generating a sound control signal from the smart phone based on the driving information to diminish or amplify the interior noise;

amplifying the sound control signal received from the smart phone to output an amplified signal through a speaker; and controlling the interior noise by diminishing or amplifying the interior noise through the sound output from the speaker.

8. The method of claim 7, further comprising: automatically calculating a interior transfer function of a sound output from the speaker and measured by the microphone of the smart phone when the sound control signal of the smart phone is amplified and output through the speaker.

9. The method of claim 7, wherein the controlling of the interior noise includes:

comparing an interior noise level sensed by the microphone of the smart phone with a profile of a sound level desired by a user;

generating a sound control signal having the same frequency as that of the interior noise and a phase opposite to that of the interior noise when the interior noise level is greater than the profile such that the sound control signal diminishes the interior noise; and generating the sound control signal having the same frequency and phase as those of the interior noise when the interior noise level is lower than the profile such that the interior noise is amplified.

10. The method of claim 7, further comprising:

designing the profile of sound desired by a user; and sharing the designed profile through a sound source sharing server to and from which the smart phone downloads and uploads the designed profile.

11. The method of claim 7, wherein the driving information includes a vehicle speed and an engine revolution per minute (RPM).

* * * * *